US009739512B2

(12) United States Patent
Rao

(10) Patent No.: US 9,739,512 B2
(45) Date of Patent: Aug. 22, 2017

(54) CONTROL SYSTEM FOR THERMOELECTRIC DEVICES

(75) Inventor: Anantha Krishnan Rama Rao, Chennai (IN)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 736 days.

(21) Appl. No.: 13/102,896

(22) Filed: May 6, 2011

(65) Prior Publication Data

US 2012/0031453 A1 Feb. 9, 2012

(30) Foreign Application Priority Data

Aug. 9, 2010 (IN) ..... 2265/CHE/2010

(51) Int. Cl.
*H01L 35/02* (2006.01)
*F25B 21/02* (2006.01)

(52) U.S. Cl.
CPC ..... *F25B 21/02* (2013.01); *F25B 2321/0212* (2013.01); *F25B 2700/2104* (2013.01)

(58) Field of Classification Search
CPC ..... F25B 21/02; F25B 2321/0212; F25B 2321/02; F25B 2700/2107; H01L 35/02
USPC ..... 62/302, 426, 158; 327/141; 136/242, 136/22; 219/494
See application file for complete search history.

(56) References Cited

U.S. PATENT DOCUMENTS

| | | | | |
|---|---|---|---|---|
| 4,757,688 | A | 7/1988 | Basiulis et al. | |
| 5,088,098 | A | 2/1992 | Muller et al. | |
| 5,225,811 | A * | 7/1993 | Audy | 340/584 |
| 5,604,758 | A * | 2/1997 | AuYeung et al. | 372/34 |
| 6,744,021 | B2 * | 6/2004 | Krieger et al. | 219/494 |
| 6,748,747 | B2 | 6/2004 | Hoschek | |
| 6,917,203 | B1 * | 7/2005 | Perotti et al. | 324/418 |
| 2004/0070436 | A1 * | 4/2004 | Kudo et al. | 327/175 |
| 2005/0235652 | A1 * | 10/2005 | Iwasaki | 62/3.7 |
| 2006/0262818 | A1 | 11/2006 | Kumar et al. | |
| 2008/0106293 | A1 | 5/2008 | Hashimoto | |
| 2011/0006124 | A1 * | 1/2011 | Kai | G05D 23/1919 236/46 R |

FOREIGN PATENT DOCUMENTS

WO WO2006017755 2/2006

OTHER PUBLICATIONS

Maxim, "Integrated Temperature Controllers for Peltier Modules," MAX1978/MAX1979, Maxim Integrated Products, pp. 1-19, Mar. 2010.

(Continued)

*Primary Examiner* — Jianying Atkisson
*Assistant Examiner* — Harry Arant
(74) *Attorney, Agent, or Firm* — Moritt Hock & Hamroff LLP; Steven S. Rubin, Esq.

(57) ABSTRACT

A system and method to control a thermoelectric device using a microcontroller is provided. The system and method include a temperature sensor operatively coupled to a microcontroller that has a central processing unit, at least one memory device, and a module for generating at least one pulse width modulation signal. The at least one pulse width modulation signal generated by the microcontroller has "ON" and "OFF" states to drive the thermoelectric device.

20 Claims, 15 Drawing Sheets

(56) References Cited

OTHER PUBLICATIONS

Analog Devices, "Thermoelectric Cooler Controller," ADN8830, Analog Devices, Inc., pp. 1-24, 2002.
Linear Technology, "High Efficiency Thermoelectric Cooler Controller," LTC1923, Linear Technology Corporation, pp. 1-28, 2001.
NetBurner, "Mod5282—PWM Generation Using General Purpose Timers," pp. 1-4, Jul. 2003.
Accuthermo Technology, "FTC200 TEC Temperature Controller for Embedded Applications," p. 1, Accuthermo Technology Corp., 2009, <http://www.accuthermo.com/products_5.asp?pid=1018200911653478138 6&pname=FTC200+TEC+Temperature+Controller+for+Embedded+Applications>.
Accuthermo Technology, "FTC200 Embedded TE Temperature Controller," Accuthermo Technology Corp. Oct. 26, 2009.
Accuthermo Technology, "FTC200 & FTA/FTX Quick Installation & Jumper Setting Guide," pp. 1-8, Accuthermo Technology Corp., 2009.
Accuthermo Technology, "FTC200 Embedded Temperature Controller—Communication Protocol Reference Manual," pp. 1-12, Accuthermo Technology Corp., 2009.
Accuthermo Technology, "FTC200 Temperature Controller Software User's Guide," pp. 1-18, Accuthermo Technology Corp., 2009.

* cited by examiner

| A/D Converter Value | Temperature |
|---|---|
| 01 | Tmin (T+) |
| 02 | T2 |
| ⋮ | ⋮ |
| ⋮ | ⋮ |
| ⋮ | ⋮ |
| ⋮ | ⋮ |
| FE | Tmax -1 |
| FF | Tmax |

FIG. 14

| Temperature | PWM Duty Cycle |
|---|---|
| Tmin (T1) | 1% |
| T2 | 2% |
| ⋮ | ⋮ |
| ⋮ | ⋮ |
| ⋮ | ⋮ |
| Tmax -1 | 98% |
| Tmax | 99% |

FIG. 15

CONTROL SYSTEM FOR THERMOELECTRIC DEVICES

CROSS-REFERENCE TO RELATED APPLICATION

This application claims priority to Indian Patent Application Serial No. 2265/CHE/2010, filed on Aug. 9, 2010, the contents of which are incorporated by reference herein in its entirety.

BACKGROUND

Various thermo-management systems exist and are well known. The most common cooling system uses the vapor-compression Rankine Cycle, which is the basis for most of today's refrigerators, freezers, and air conditioners. Solid-state refrigeration devices, however, based on thermoelectric or electrocaloric effects (ECE) could provide higher energy efficiencies than traditional vapor compression cooling (VCC) technologies, eliminate the use of refrigerants (and the resultant greenhouse gas emissions), and increase the longevity of cooling devices and products. Thermoelectric and electrocaloric effects provide for the heating and cooling of a material by the application and/or removal of an applied electric field. With proper control and cycling, these effects could be used for refrigeration, air conditioning, heat pumping, and other thermo-management systems.

One example of a solid-state refrigeration device based on thermoelectric effects is a thermoelectric cooler (TEC). Generally, a TEC is a device where current flow through the device heats one side of the device, while at the same time, cools the other side of the device. The side that is heated and the side that is cooled are controlled by the direction of the current flow. Thus, current flow in one direction will heat a first side, while current flow in the opposite direction will cool the same first side. For cooling an object, voltage is applied to the TEC and current is directed through the TEC in such a way that the cool the side of the TEC is adjacent the object. As a result, the object is cooled by the TEC. With proper cycling, a TEC may be used to effectively heat and/or cool an object to maintain a constant operating temperature.

Despite their advantages, thermoelectric devices generally have significantly lower efficiencies than conventional VCC technologies. In particular, the control systems used for these thermoelectric devices typically use complex analog circuitry that is inefficient, expensive, lacks flexibility, is not customizable, and is not easily upgradable. For example, a TEC is commonly controlled and driven by an analog circuit comprising analog amplifiers, switches, resistors, capacitors, and/or inductors.

SUMMARY

A system and methods are described, substantially as shown in and/or described in connection with at least one of the figures, as set forth more completely in the claims, which provides a manner for controlling a thermoelectric device.

In one example aspect, a control system for thermoelectric devices is provided. The control system comprises a temperature sensor and a microcontroller operatively coupled to the temperature sensor. The microcontroller comprises a central processing unit, at least one memory device, and a module for generating at least one pulse width modulation signal. The at least one pulse width modulation signal generated by the microcontroller drives a thermoelectric device.

In another example aspect, a method of controlling a thermoelectric device is provided. The method comprises providing a microcontroller operatively coupled to a temperature sensor, with the microcontroller comprising a central processing unit, at least one memory device, and a module operatively coupled to a thermoelectric device. The method further comprises generating at least one pulse width modulation signal with the module of the microcontroller, and transmitting the at least one pulse width modulation signal from the microcontroller to the thermoelectric device. In addition, the method comprises driving the thermoelectric device in accordance with the at least one pulse width modulation signal.

In a further example aspect, a microcontroller for controlling a thermoelectric device is provided. The microcontroller comprises at least one memory device having a set of operating instructions for the microcontroller, a central processing unit to execute the set of operating instructions, and a module to generate at least one pulse width modulation signal that can drive the thermoelectric device. The at least one pulse width modulation signal comprises at least a first state and a second state. The first state turns the thermoelectric device on, while the second state turns the thermoelectric device off. The pulse width modulation signal comprises at least two separate first states and at least two separate second states.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 14 illustrates an example lookup table for temperature readings determined by the control system of FIG. 1.

FIG. 15 illustrates an example lookup table for duty cycles determined by the control system of FIG. 1.

DETAILED DESCRIPTION

Figure 1:
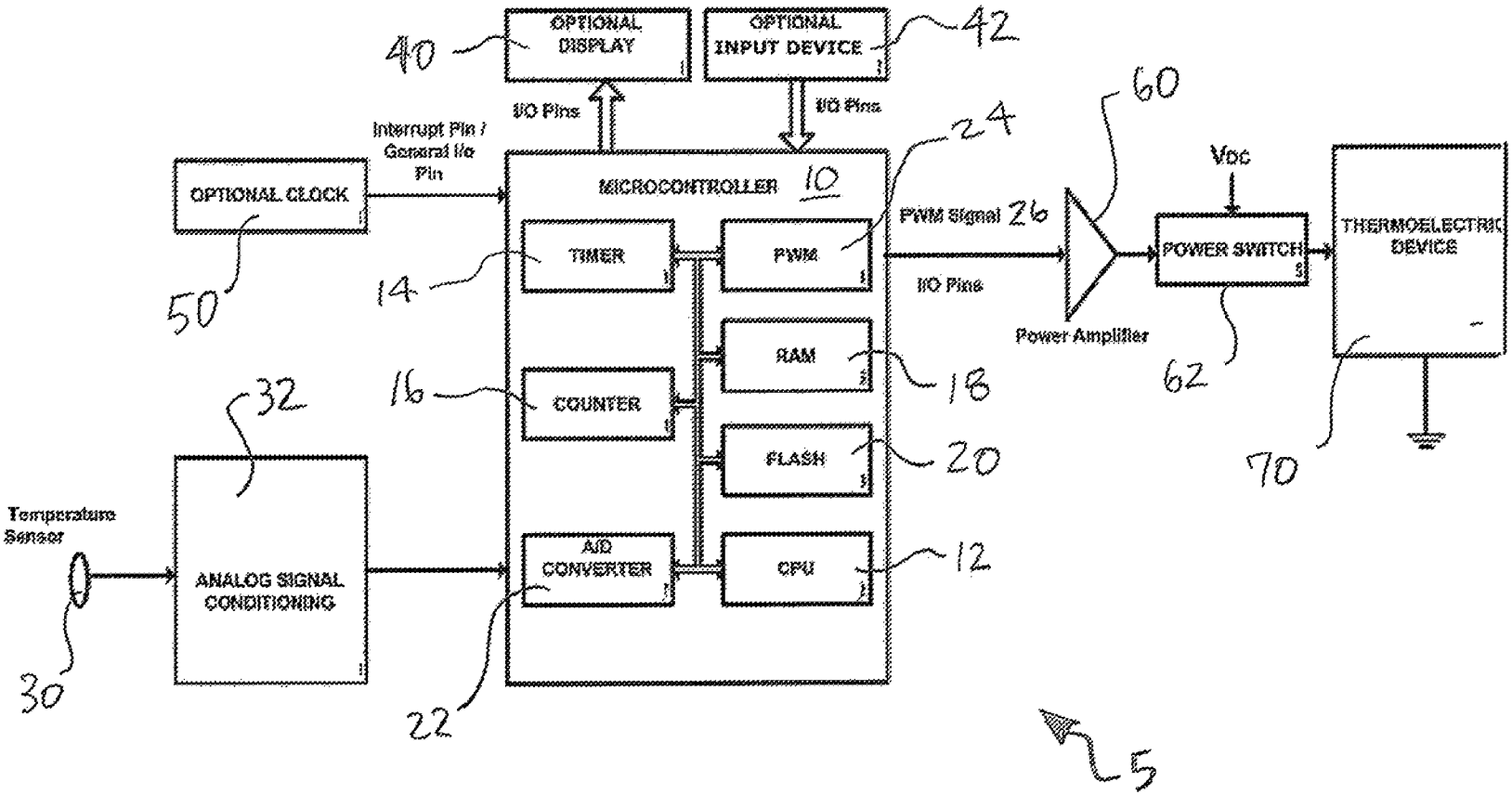
FIG. 1 illustrates an example block diagram of a control system for controlling a thermoelectric device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The present application provides a control system for thermoelectric devices. Unlike the prior art, which relies on an analog circuit to control and drive a thermoelectric device, the thermoelectric device in the present application is controlled and driven by a signal generated directly by a microcontroller. As a result of using a microcontroller to control and drive the thermoelectric device, the control system of the present application is efficient, inexpensive, flexible, upgradeable, and fully customizable. For example, the set of operation instructions (i.e., firmware/software) stored in memory on the microcontroller can be easily customized, modified, and/or upgraded by a user. Such flexibility is not available when analog circuitry is used to control and generate the drive signal for the thermoelectric device. Moreover, using a single microcontroller to generate the drive signal for the thermoelectric device avoids the need for the complex configurations and multiple hardware components that are typically used in the analog circuits of the prior art. Thus, the use of a microcontroller in the present application is not only less expensive, but also more efficient, than the prior art.

Although the description and drawings set forth herein refer to thermoelectric devices, it should be understood that the present application may also be used to control electrocaloric devices. It should also be understood that although the present application describes, by way of example, control systems and methods for cooling applications, the present application may equally be used with control systems and methods for heating applications. It should be further understood that the reference to thermoelectric coolers (TEC) in the present application is intended to broadly cover other thermoelectric devices besides TECs, and the present application is not limited to TECs for the control systems and methods described herein.

The present application describes a system and method to control a thermoelectric device with a drive signal, such as a pulse width modulation (PWM) signal, generated by a microcontroller. As shown in FIG. 1, the control system 5 comprises a microcontroller 10, a temperature sensor 30, an analog signal conditioner 32, an optional display 40, an optional input device 42, an optional external clock 50, a power amplifier 60, and a power switch 62. As also shown in FIG. 1, the control system 5 is used to control at least one thermoelectric device 70.

As shown in FIG. 1, the microcontroller 10 comprises a central processing unit (CPU) 12, a timer 14, a counter 16, at least one memory device, such as a first memory device 18 (e.g., a random access memory device (RAM)) and a second memory device 20 (e.g., a flash memory device), an analog-to-digital (A/D) converter 22, and a pulse width modulation (PWM) module 24. All of these components of the microcontroller are coupled or operatively coupled to each other, as shown in FIG. 1. It should be understood, however, that the microcontroller 10 may have more or less than these components depending on design, user, and/or manufacturing preferences. For example, the timer 14 and counter 16 may not be necessary for the microcontroller 10, and only one of the memory devices may be needed for the microcontroller 10. It should further be understood that the components of the microcontroller, such as the central processing unit, the at least one memory device, and the module, may be integral parts of the microcontroller, or alternatively, may be discrete components (e.g., discrete integrated circuits) interconnected together to form the microcontroller. Although not fully shown in FIG. 1, it should also be understood that the microcontroller 10 may have any number of different input/output (I/O) pins for connecting one or more external components, such as the analog signal conditioner 32, the optional display 40, the optional input device 42, the optional external clock 50, and the power amplifier 60, to the microcontroller 10.

The CPU 12 may be used to execute a set of operating instructions (e.g., firmware/software) for the microcontroller 10 that is stored in, for example, the second memory device 20. The CPU may also be used to read and write data into, for example, the first memory device 18.

The timer 14 and/or counter 16 may be used to control the timing and sequence of events or processes that are being handled by the microcontroller 10. For example, the timer 14 and/or counter 16 may be used as a time base clock by the PWM module 24 to generate the drive signal for the thermoelectric device 70, as explained in more detail below. It should be understood that the timer 14 and/or the counter 16 may be integrated with the PWM module 24 or they may be relocated externally from the microcontroller 10.

The first memory device 18 may be a volatile memory device, such as a RAM device, for storing data used by the microcontroller to generate its drive signal. For example, the first memory device may be used to store temperature readings provided by the temperature sensor 30. The second memory device 20 may be a non-volatile memory device, such as a Read Only Memory (ROM) or flash memory device, and may be used to store the operating instructions that are to be executed by the CPU 12 of the microcontroller 10. The second memory may also be used to store the default settings, such as temperature and operating modes for the control process set by the user or thermoelectric device manufacturer. It should be understood, however, that the microcontroller 10 of the present application may use only a single memory device, or alternatively, may use other memory devices in addition to the first and second memory devices 18, 20.

The A/D converter 22 is used to convert at least one analog temperature signal generated by the temperature sensor 30 into at least one digital temperature signal that can be processed by the microcontroller 10.

As shown in FIG. 1, the PWM module 24 is a dedicated module of the microcontroller 10 that is operatively coupled to the thermoelectric device 70. The PWM module 24 generates at least one drive signal, such as at least one pulse width modulation signal 26. The PWM module 24 generates the timing (e.g., ON/OFF drive periods) required for the PWM signal 26 in order to control the duty cycle ($T_{ON}/(T_{ON}+T_{OFF})$) of the PWM signal 26. The PWM module 24 may generate the PWM signal 26 through an I/O pin of the microcontroller based on the initial configuration or may generate an interrupt to the microcontroller. The routine for this interrupt may generate the PWM signal 26 based on register values of the PWM module 24 to drive the I/O pin that in turn drives the thermoelectric device 70.

Although not shown in FIG. 1, the PWM module 24 may include one or more registers, memory locations, counters, timers, and other internal components. The microcontroller may be programmed to form a PWM module 24 using the internal or external components such as the timer 14 and/or the counter 16 to generate the PWM signal 26. In one example embodiment, the PWM module comprises two sets of registers and counters—one set of registers and counters for setting and comparing a duty cycle period for the at least one PWM signal, and another set of registers and counters for setting and comparing the "ON" time for the at least one PWM signal 26. The microcontroller may also be programmed to generate the PWM signal with respect to the temperature sensor 30 output. It should be understood, however, that in the control system 5, the PWM signal 26 is generated by the microcontroller without the need of analog comparators.

Using a dedicated module, such as the PWM module 24, to generate the drive signal reduces the load on the microcontroller's CPU and enables the microcontroller to drive the thermoelectric device without using as much of the CPU's resources. While the PWM module 24 is shown as a dedicated module in the block diagram of FIG. 1, it should be understood that the PWM module 24 and its functionality may be replaced by software run by the CPU 12.

As discussed in more detail below, the at least one PWM signal 26 that is generated by the PWM module 24 may be a waveform pattern with a first state 27 and a second state 28. The first state 27 of the at least one PWM signal 26 is, for example, a logic level that corresponds to an "ON" state for the thermoelectric device 70. The second state 28 of the at least one PWM signal 26 is, for example, an alternate logic level that corresponds to an "OFF" state of the thermoelectric device 70. In one example embodiment, the at least one PWM signal 26 comprises at least two separate first states and at least two separate second states, such that the thermoelectric device is turned "ON" at least twice and turned "OFF" at least twice. It should be understood, however, that in an inverted drive application, the logic levels of the first and second states may be reversed. For example, the first state 27 may correspond to an "OFF" state for the thermoelectric device 70, and the second state 28 may correspond to an "ON" state of the thermoelectric device 70.

Figure 2:
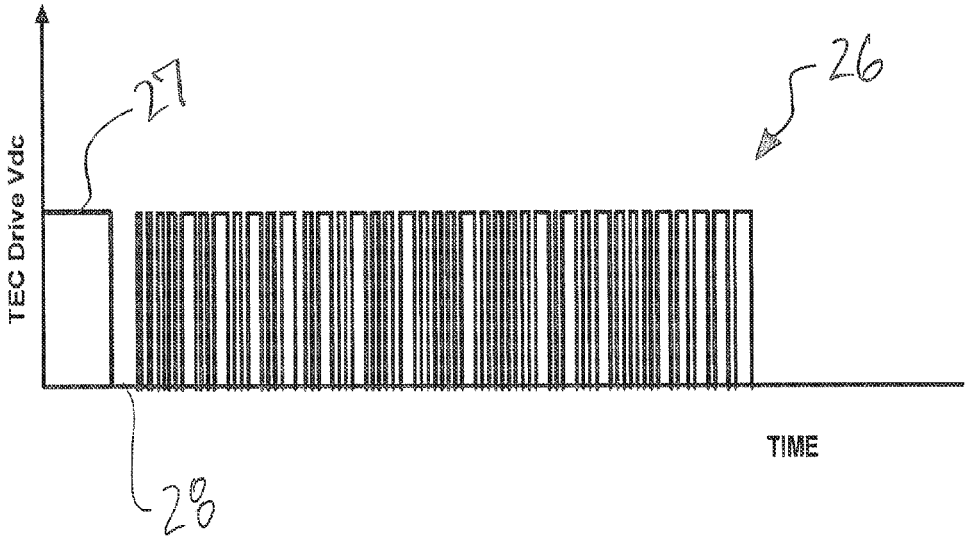
FIG. 2 illustrates an example timing diagram of a pulse width modulation signal generated by the control system of FIG. 1.
Figure 3:
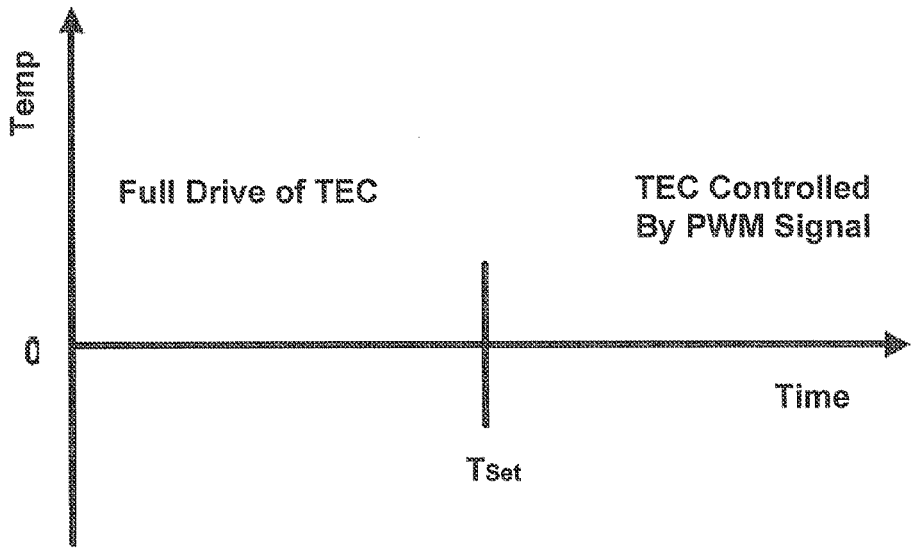
FIG. 3 illustrates an example temperature versus time diagram for operation of the control system of FIG. 1.

FIG. 2 provides an illustration of the at least one PWM signal 26 over time in a waveform pattern with several separate first states and at least two separate second states, such that the thermoelectric device is turned "ON" and turned "OFF" several times. As shown in FIG. 2, the pattern of first and second states, the number of occurrences of such states, and the length of time for each occurrence of each state, may all be varied depending on design, user, and/or manufacturing preferences.

Returning to FIG. 1, the temperature sensor 30 may be used to sense or read the temperature of the object that is being heated or cooled. For example, if the object being heated or cooled was a room, the temperature sensor would sense or read the room temperature. The temperature sensor 30 is operatively coupled to the A/D converter 22 of the microcontroller 10. After sensing/reading the temperature, the temperature sensor 30 generates at least one corresponding analog temperature signal that is transmitted to the A/D converter 22. As shown in FIG. 1, the at least one analog temperature signal may be conditioned by the analog signal conditioner 32 before it is sent to the A/D converter 22. As explained above, once the at least one analog temperature signal generated by the temperature sensor 30 is received by the A/D converter 22, the at least one analog temperature signal is converted by the A/D converter 22 into at least one digital temperature signal that is used by the microcontroller 10. The A/D convertor may also be an integral part of the digital temperature sensor module and may be interfaced with the microcontroller through a standard communication channel or data bus, such as a USB, I2C, SPI, or parallel bus.

As shown in FIG. 1, the control system 5 may include a display 40 and an input device 42. The display 40 and input device are coupled to the microcontroller 10 via one or more sets of I/O pins. The display 40 may be used to convey information and data being processed by the microcontroller 10 to a user of the control system 5. For example, the display 40 may be used to show the current temperature, whether the thermoelectric device is "ON" or "OFF," and the desired set temperature. The input device 42 may be used by a user of the control system 5 to modify the settings of the microcontroller 10. For example, the input device 42 may be a keyboard and/or mouse that may be used by a user of the control system 5 to modify the temperature settings and/or duty cycle of the at least one PWM signal.

An external clock 50 may be used in the control system 5 and may be coupled to the microcontroller 10 via an interrupt or a general I/O pin, as shown in FIG. 1. The external clock 50 may be an independent time source with a quartz timing crystal that is not dependant on internal synchronization within the microcontroller. Consequently, the external clock 50 may be used to generate an external time signal that can be used by the microcontroller to generate the drive signal. The external clock 50 may be used to generate long duty cycle control for the thermoelectric device without additional overhead on the components of the microcontroller.

As shown in FIG. 1, the power amplifier 60 is coupled to the microcontroller 10 via a set of I/O pins. The power amplifier 60 is used to amplify the at least one PWM signal 26 that it receives from the PWM module 24 of the microcontroller 10. The amplified PWM signal 26 is then used to turn "ON" or "OFF" the thermoelectric device 70 via a power switch 62, such as a MOSFET, IGBT, bipolar transistor, TRIAC, or SCR, that is coupled to a voltage source for driving the thermoelectric device. It should be understood, however, that the power amplifier 60 may not be required if the microcontroller has sufficient power to drive the power switch 62 without the need for separate amplification.

The thermoelectric device 70 may be any number of thermoelectric devices known and used in the art. For example, the thermoelectric device 70 may be a thermoelectric cooler (TEC) that provides solid-state refrigeration or other cooling applications. As previously mentioned, it should be understood that an electrocaloric device may be substituted for the thermoelectric device in the present application. Moreover, it should be understood that more than one thermoelectric or electrocaloric device, which may or may not be the same, may be controlled by the control system 5.

FIGS. 3-8 show various temperature settings, duty cycles, patterns, and waveforms for the at least one PWM signal 26. As mentioned above, these figures relate to cooling applications, but could be readily switched to work with heating applications. Beginning with the general temperature/timing diagram of FIG. 3, during initial startup of the at least one thermoelectric device, the at least one thermoelectric device (e.g., TEC) is fully driven in the "ON" state until the temperature measured by the temperature sensor 30 reaches the desired set temperature ($T_{Set}$). Once the desired set temperature has been achieved, the PWM module 24 generates at least one PWM signal 26 to control the at least one thermoelectric device (e.g., TEC) and maintain the set temperature.

The at least one PWM signal 26 includes a duty cycle for the at least one thermoelectric device. The term "duty cycle" describes the proportion of "ON" time for the at least one thermoelectric device to the regular interval or total period of time for the at least one thermoelectric device and the at least one PWM signal. In other words, the duty cycle for the at least one thermoelectric device that is included in the at least one PWM signal represents the ratio of the "ON" time to the total "ON" and "OFF" time of the at least one thermoelectric device. The duty cycle is expressed and referred to herein as a percentage, with 100% meaning that the at least one thermoelectric device is fully "ON." The lower the duty cycle percentage, the lower the power consumption by the at least one thermoelectric device, because the power is "OFF" for more of the time. For example, a duty cycle of 50% results in less power consumption, and thus more energy savings, than a duty cycle of 80%.

After the at least one thermoelectric device has been fully driven to and initially achieves the set temperature during startup (FIG. 2), the nature of the duty cycle of the at least one PWM signal 26 that is generated by the PWM module 24 may vary and may depend on the mode of operation that has been selected by a user or specified by the control system. The control system 5 may have one or more modes of operation, including, but not limited to, a normal mode of operation and/or a power save mode of operation. In addition, there may be more than one normal mode of operation and/or more than one power save mode of operation.

In one example embodiment, there are at least two modes of operation—at least one normal mode of operation and at least one power save mode of operation. In the at least one normal mode, the at least one PWM signal 26 provides a duty cycle to maintain the at least one thermoelectric device within upper and lower hysteresis limits of the desired set temperature. In one example embodiment of the at least one normal mode, the duty cycle used is less than 100%, with alternating "ON" and "OFF" states (i.e., alternating first and second states). A duty cycle of less than 100% is possible because the use of hysteresis limits avoids having to continuously drive the at least one thermoelectric device to account for undershoots and overshoots of the set temperature. It should be understood that the upper and lower hysteresis limits may be set close to the set temperature. For instance, if the set temperature was 16° C., the upper hysteresis limit may be set at 16.5° C., while the lower hysteresis limit may be set at 15.5° C. The upper and lower hysteresis limits, however, may be set higher or lower than this example, depending on the design, user, and/or manufacturing preferences for the particular application being utilized. Alternatively, the at least one normal mode of operation may not use any hysteresis limits. Moreover, the at least one normal mode of operation may use a duty cycle of 100%.

Figure 4:
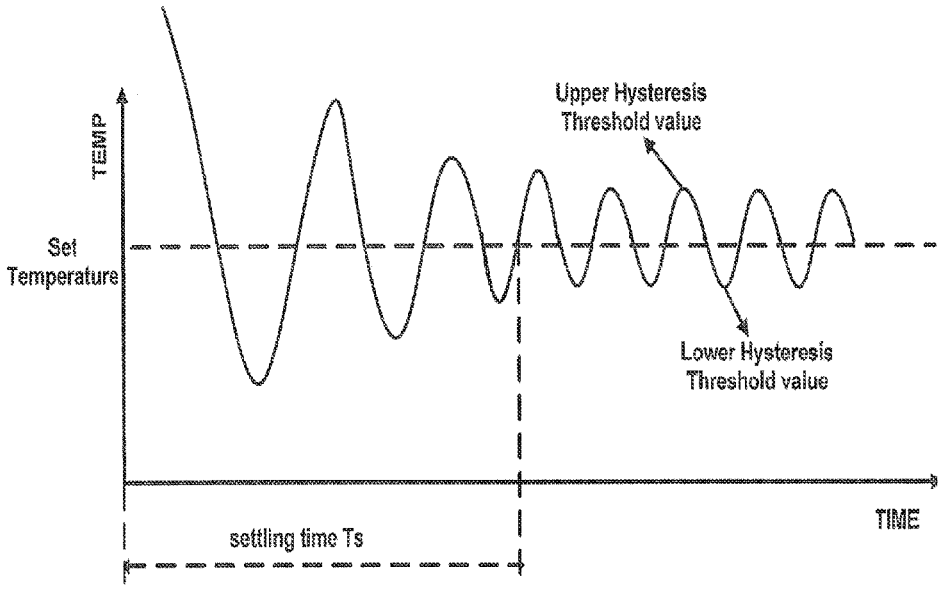
FIG. 4 illustrates an example temperature versus time diagram for a normal mode of operation of the control system of FIG. 1.
Figure 5:
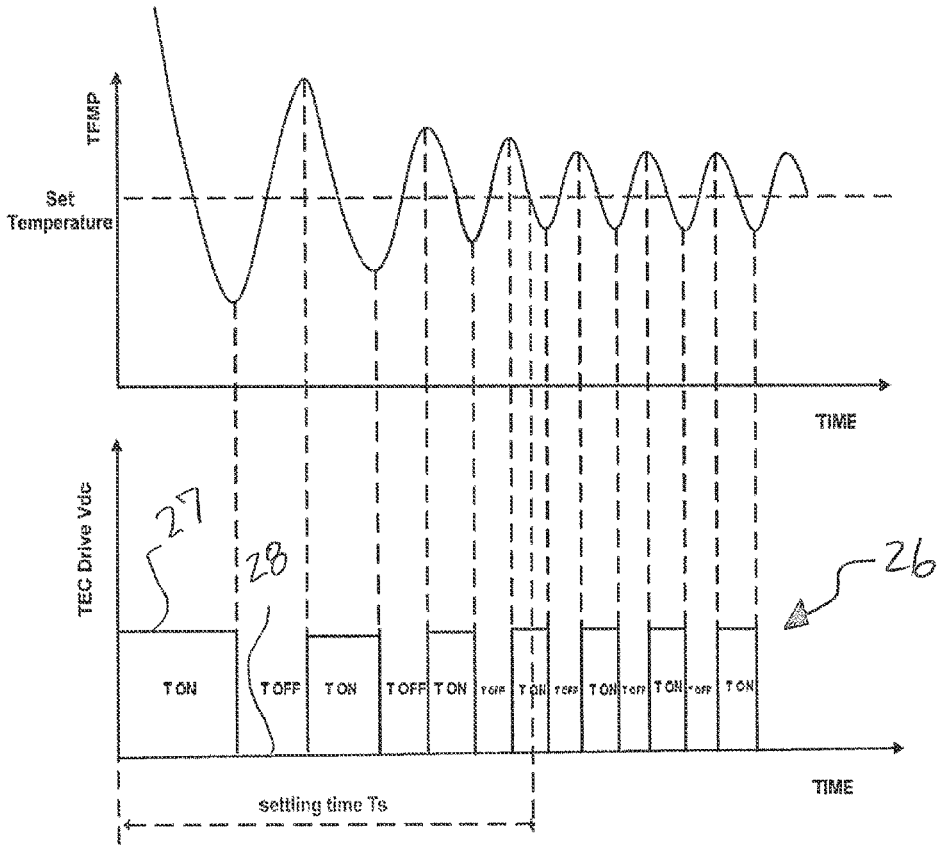
FIG. 5 illustrates the example diagram of FIG. 4, together with an example diagram of a corresponding pulse width modulation signal over time.

FIG. 4 shows a temperature/timing diagram for one example normal mode for the present application, while FIG. 5 shows the temperature/timing diagram of FIG. 4 together with a diagram of the corresponding waveform pattern of the at least one PWM signal 26 over time. After an initial settling time ($T_s$) to allow for the overshooting and undershooting of the set temperature by the driven thermoelectric device, the at least one thermoelectric device is driven by the at least one PWM signal 26 to maintain the temperature between the predefined hysteresis limits of the set temperature. As shown in FIG. 5, after the settling time has passed, once the lower hysteresis limit for the set temperature has been achieved, the at least one thermoelectric device is turned "OFF" (i.e., second state), and once the higher hysteresis limit is reached, the at least one thermoelectric device is turned "ON" (i.e., first state).

In the example shown in FIGS. 4-5, the pattern for the at least one PWM signal is determined by the microcontroller based on several system parameters, such as the temperature sensed/read by the temperature sensor (e.g., room temperature), the set temperature, the set temperature hysteresis limits, the power and efficiency of the thermoelectric device being employed, the voltage supply for the thermoelectric device, the thermal insulation being used, the atmospheric temperature, etc. As a result, the control system is constantly monitoring the temperature sensed/read by the temperature sensor, considering the system parameters, and adjusting the at least one PWM signal accordingly to maintain the temperature within the defined hysteresis limits. Accordingly, changes in any of the system parameters may result in changes to the at least one PWM signal. For instance, if the at least one thermoelectric device loses power or voltage, or becomes less efficient over time, the duty cycle of the at least one PWM signal may have to be increased to maintain the temperature within the hysteresis limits of the set temperature.

In an alternative normal mode of operation, the at least one PWM signal is defined and generated by the microcontroller independent of several system parameters. In this alternative normal mode example, the at least one PWM signal may be defined by the microcontroller as shown in FIG. 2 and as explained below with reference to FIG. 12. In this example alternate normal mode of operation, there is no user programmable option for setting an upper temperature limit or a lower temperature limit, and the higher and lower temperature is predefined by the thermoelectric device manufacturer depending upon the achievable accuracy of the thermoelectric device control. In this example, the hysteresis limits are also predefined to be close to the set temperature value to avoid drive control system oscillations. For this example, the user sets only the operating temperature, and the operating temperature range setting is not available in this alternative normal mode of operation.

Figure 6:
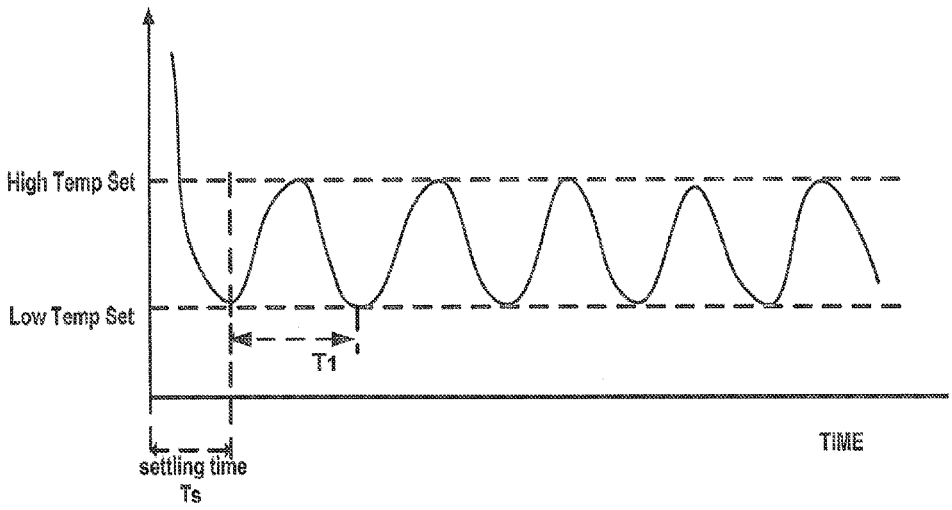
FIG. 6 illustrates an example temperature versus time diagram for a power save mode of operation of the control system of FIG. 1.
Figure 7:
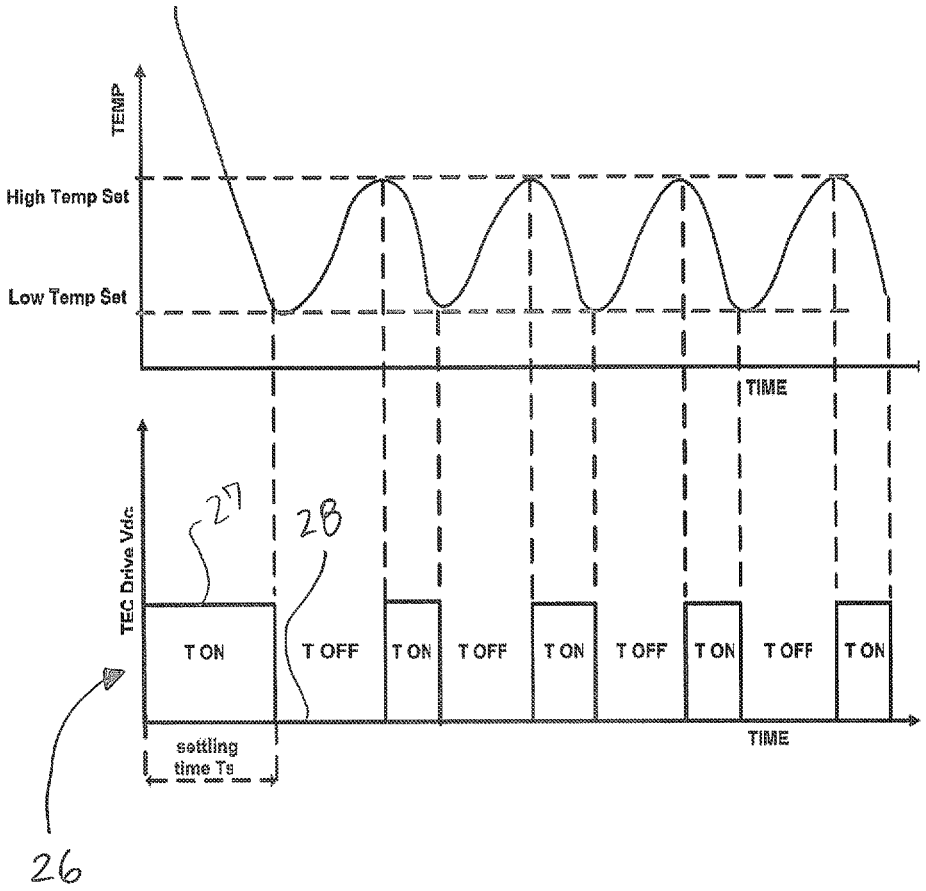
FIG. 7 illustrates the example diagram of FIG. 6, together with an example diagram of a corresponding pulse width modulation signal over time.
Figure 8:
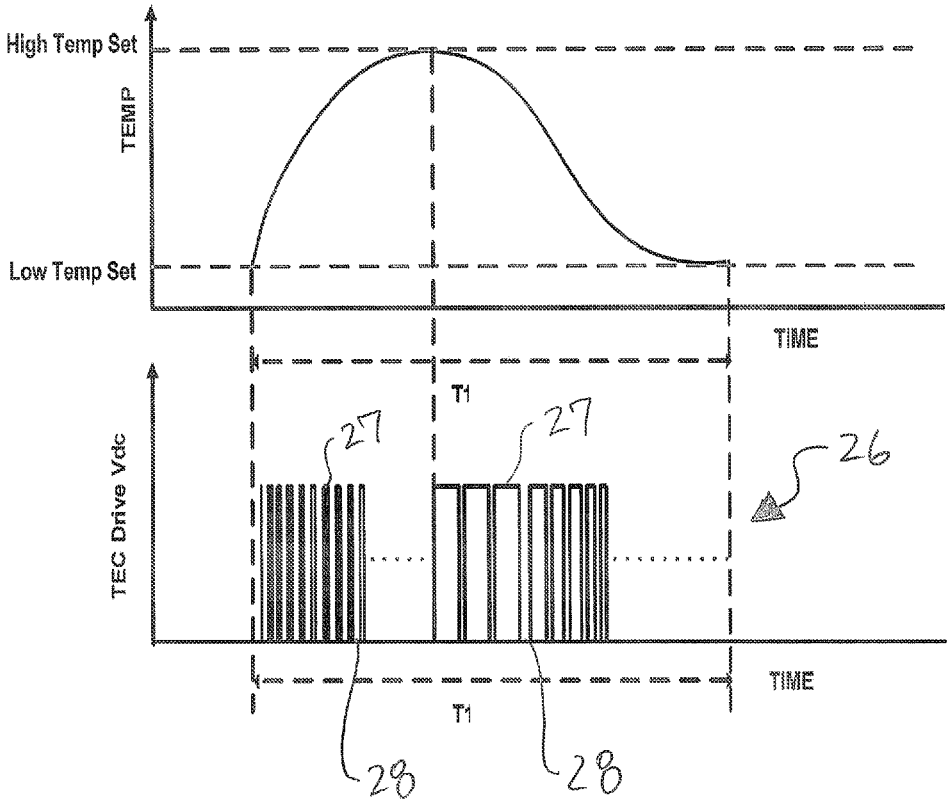
FIG. 8 illustrates another example temperature versus time diagram for a power save mode of operation of the control system of FIG. 1, together with an example diagram of a corresponding pulse width modulation signal, over a single thermal cycle of time.

FIGS. 6-8 illustrate examples of the at least one power save mode for the present application. In the at least one power save mode, the at least one PWM signal 26 provides a duty cycle less than 100% with alternating "ON" and "OFF" states (i.e., alternating first and second states) to maintain the temperature within a high set temperature and a low set temperature. In one example embodiment, the range between the high and low set temperatures of the at least one power save mode is greater than the range between the upper and lower hysteresis limits of the set temperature in the at least one normal mode. As a result of this greater range, the duty cycle and power consumption of the at least one power save mode is lower than the at least one normal mode. The high and low set temperatures may be predefined or customized by the user for the at least one power save mode, depending on the design, user, and/or manufacturing preferences.

The use of high and low set temperatures, as opposed to just upper and lower hysteresis limits, further minimizes the "ON" time and amount of energy needed for the at least one thermoelectric device to maintain a temperature. It should be understood that the high and low set temperatures may be set an equal distance above and below a desired set temperature. For instance, if the desired set temperature was 16° C., the high set temperature may be set at 19° C., while the low set temperature may be set at 13° C. The high and low set temperatures, however, may be set higher or lower than this example, depending on the design, user, and/or manufacturing preferences for the particular application being utilized.

FIG. 6 shows a temperature/timing diagram for one example power save mode for the present application, with a single thermal cycle being represented by $T_1$, while FIG. 7 shows the temperature/timing diagram of FIG. 6 together with a diagram of the corresponding waveform pattern of the at least one PWM signal 26 over time. After an initial settling time ($T_s$) the at least one thermoelectric device is driven by the at least one PWM signal 26 to maintain the temperature between the high and low set temperatures. As shown in FIG. 7, after the settling time has passed, once the low set temperature has been achieved, the at least one thermoelectric device is turned "OFF" (i.e., second state), and once the high set temperature is reached, the at least one thermoelectric device is turned "ON" (i.e., first state).

In the example shown in FIGS. 6-7, the pattern for the at least one PWM signal is determined by the microcontroller based on several system parameters, such as the temperature sensed/read by the temperature sensor (e.g., room temperature), the specified high and low set temperatures, the power and efficiency of the thermoelectric device being employed, the voltage supply for the thermoelectric device, the thermal insulation being used, the atmospheric temperature, etc. As a result, the control system is constantly monitoring the temperature sensed/read by the temperature sensor, considering the system parameters, and adjusting the at least one PWM signal accordingly to maintain the temperature within the specified high and low set temperatures. Accordingly, changes in any of the system parameters may result in changes to the at least one PWM signal. For instance, if the at least one thermoelectric device loses power or voltage, or becomes less efficient over time, the duty cycle of the at least one PWM signal may have to be increased to maintain the temperature within the high and low set temperatures.

In an alternative power save mode of operation, shown in FIG. 8, the at least one PWM signal is defined and generated by the microcontroller independent of several system parameters. FIG. 8 shows a temperature/timing diagram for this power save mode for a single thermal cycle ($T_1$) after an initial settling time ($T_s$) has passed, together with a diagram of the corresponding waveform pattern of the PWM signal 26 generated by the microcontroller over the same thermal cycle time period ($T_1$). The definition of the at least one PWM signal in this power save mode example is explained below with reference to FIG. 12. As shown in FIG. 8, one of the differences between this example power save mode and the power save mode shown in FIG. 7 is that the "ON" and "OFF" states of FIG. 7 are broken up into a series of shorter and interwoven "ON" and "OFF" states in FIG. 8. In other words, FIG. 7 refers to a PWM signal waveform pattern frequency that is equal to the thermal cycle ($T_1$) frequency, while FIG. 8 refers to a PWM signal waveform pattern frequency that is higher than the frequency of thermal cycle ($T_1$) and is fixed by modulating frequency. In FIG. 8, the left portion of the curve, which rises up from the low set temperature to the high set temperature, is not simply or entirely an "OFF" state, as shown in FIG. 7, but rather, a series of short "ON" states interwoven with a series of "OFF" states. In FIG. 8, the average power generated by multiple pulses of the PWM signal is lower in the left portion of the curve (i.e., the PWM signal duty cycle is low). Likewise, in FIG. 8, the right portion of the curve, which drops down from the high set temperature to the low set temperature, is not simply or entirely an "ON" state, as shown in FIG. 7, but rather, a series of "ON" states interwoven with a series of short "OFF" states. In FIG. 8, the average power generated by multiple PWM pulses is higher in the right portion of the curve (i.e., the PWM signal duty cycle is high).

It should be understood that the nature of the duty cycle may also depend on the difference between the reference/room temperature and the desired set temperature of the object being cooled. For example, if there is a large difference between the reference/room temperature and the desired set temperature, a larger duty cycle (i.e., more "ON" time) may be required to achieve and maintain the set temperature, even in a power save mode. If there is a small difference between the reference/room temperature and the desired set temperature, however, only a smaller duty cycle (i.e., less "ON" time) may be required to achieve and maintain the set temperature, even in a normal mode.

FIGS. 9-13 illustrate example flowcharts including example functional steps for different methods of controlling one or more thermoelectric devices. It should be understood that each flowchart shows the functionality and operation of one possible implementation of the example embodiments in the present application. In this regard, one or more steps/blocks may represent a module, a segment, or a portion of program code, which includes one or more instructions executable by a processor for implementing specific logical functions or steps in the process. The program code may be stored on any type of computer readable medium, for example, such as a storage device including a flash drive, disk or hard drive. In addition, one or more steps/blocks may represent circuitry that is wired to perform the specific logical functions in the process. Alternative implementations are included within the scope of the example embodiments of the present application in which functions may be executed out of order from that shown or discussed, including substantially concurrent or in reverse order, depending on the functionality involved, as would be understood by those reasonably skilled in the art.

Figure 9:
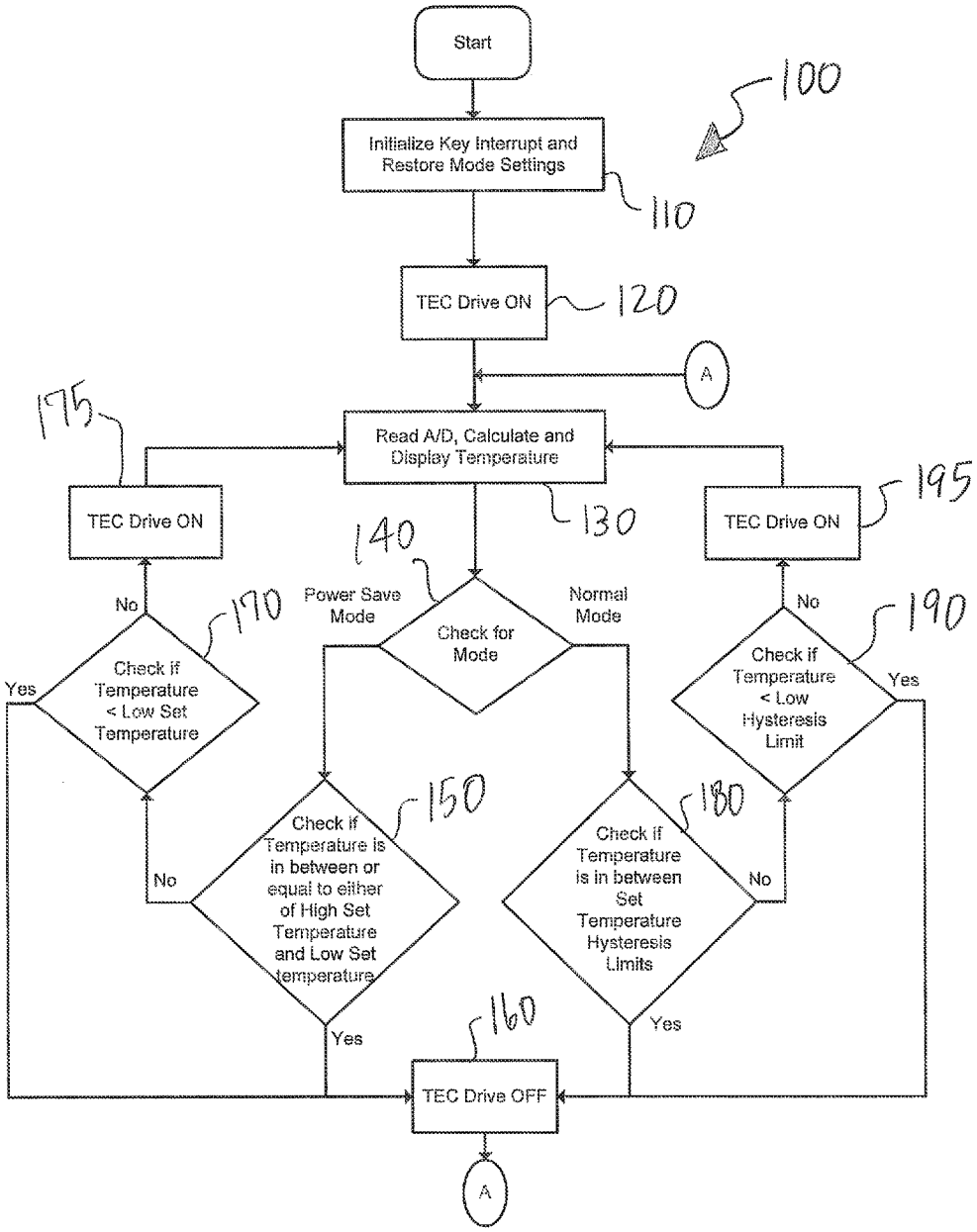
FIG. 9 illustrates an example flowchart including example functional steps for controlling a thermoelectric device with the control system of FIG. 1.

One example method 100 for operation of the control system 5 is shown in FIG. 9. The method 100 begins with step 110, wherein there is an initialization of the key interrupt and restoration of the mode settings. The process for initiating this key interrupt and selecting the mode used for the control system is discussed in more detail below and shown in FIG. 13. The next step in method 100 is step 120, wherein the at least one thermoelectric device is turned "ON." The at least one thermoelectric device is turned "ON" by the generation of at least one PWM signal in the first state.

After the at least one thermoelectric device has been turned on, in step 130, the microcontroller reads the A/D converter, calculates the temperature and, if a display is present, displays the temperature. Next, in step 140, the microcontroller checks to see what mode has been selected by the user. If a power save mode was selected, then in step 150, the temperature is checked to see if it is in between the high set temperature and the low set temperature, or equal to the high set temperature or the low set temperature. If the temperature is in between the high set temperature and the low set temperature, or it is equal to the high set temperature or low set temperature, method 100 continues to step 160, wherein the at least one thermoelectric device is turned "OFF." The at least one thermoelectric device may be turned "OFF" by the generation of at least one PWM signal in a second state. After step 160, method 100 continues back to step 130, wherein the microcontroller again reads the A/D converter, calculates the temperature, and displays the temperature (if a display is present).

If the temperature checked in step 150 is not in between the high set temperature and the low set temperature, and it is not equal to the high set temperature or the low set temperature, the method 100 continues to step 170, wherein the temperature is checked to see if it is less than the low set temperature. If the temperature is less than the low set temperature, then method 100 continues to step 160, wherein the at least one thermoelectric drive is turned "OFF," for example, by the generation of at least one PWM signal in the second state. Again, after step 160, the method 100 returns to 130. In step 170, however, if the temperature is not less than the low set temperature, then the at least one thermoelectric device is left (or turned) "ON" in step 175, and the method 100 returns to step 130.

Turning back to step 140, as shown in FIG. 9, if the user has selected a normal mode of operation, then the method 100 proceeds to step 180, wherein the temperature is checked to see if it is between the set temperature hysteresis limits (i.e., the upper and lower hysteresis limits). If the temperature is between the set temperature hysteresis limits, then the method 100 proceeds to step 160 and the at least one thermoelectric device is turned "OFF." At that point, the method 100 returns to step 130 to further monitor the temperature. On the other hand, if the temperature is not in between the set temperature hysteresis limits, then the method 100 continues to step 190, wherein the temperature is checked to see if it is less than the lower hysteresis limit. If the temperature is less than the lower hysteresis limit, then the method 100 proceeds to step 160, wherein the at least one thermoelectric device is turned "OFF" (and then the method returns to step 130). If the temperature is not less than the lower hysteresis limit, however, then the at least one thermoelectric device is left (or turned) "ON" in step 195, and the method 100 returns to step 130, wherein the A/D converter is again read by the microcontroller, the temperature is calculated, and the temperature is displayed (if a display is present).

Figure 10:
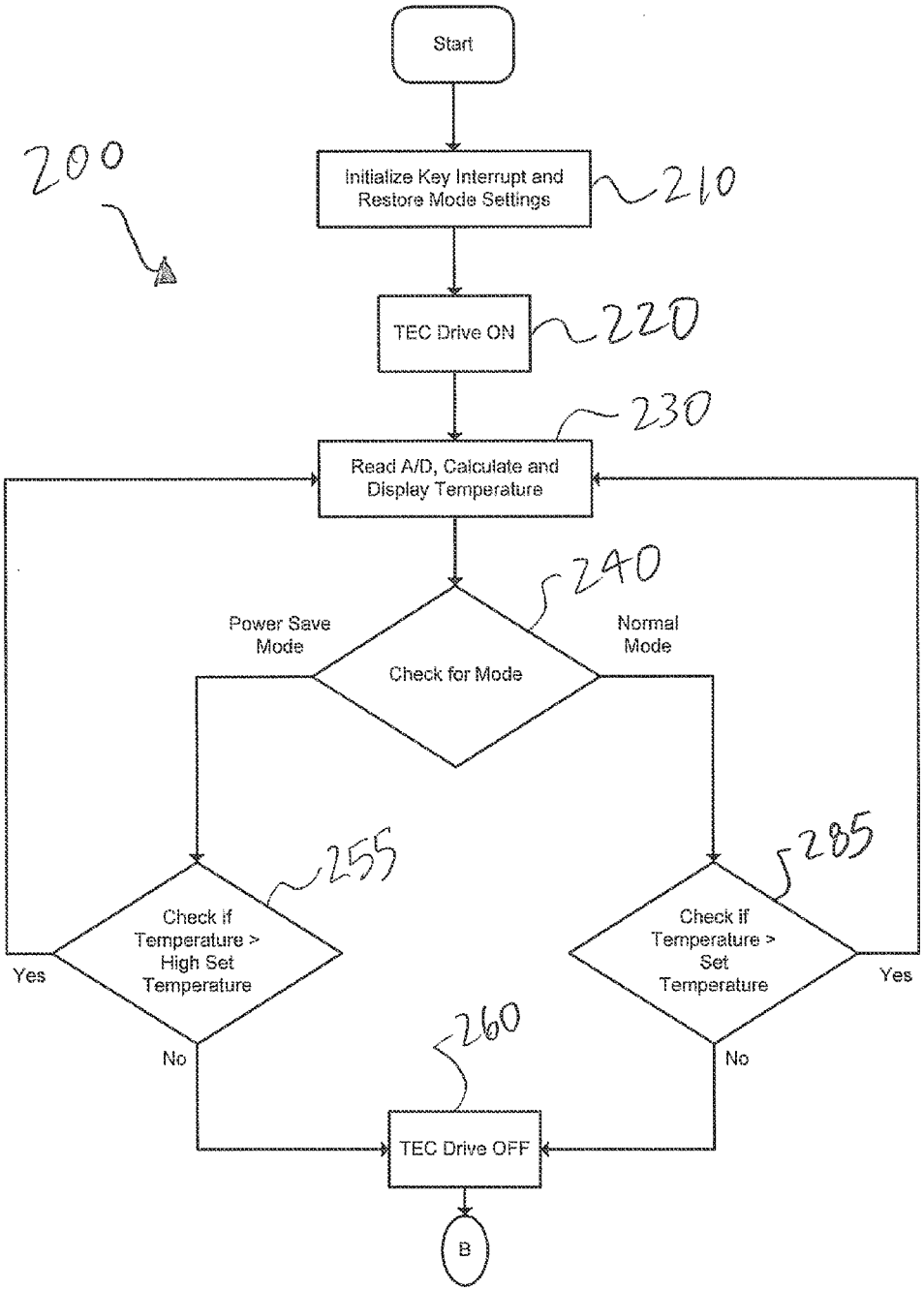
FIG. 10 illustrates another example flowchart including example functional steps for controlling a thermoelectric device with the control system of FIG. 1.

An alternative example method 200 for the control system 5 is shown in FIG. 10. In the method 200, the steps 210, 220, 230, and 240, are the same as the corresponding steps 110, 120, 130, 140, respectively, of method 100. If the determination in step 240 results in a power save mode having been selected, then 200 method proceeds to step 255 where the temperature is checked to see if it is greater than the high set temperature. If the temperature is greater than the high set temperature, then the at least one thermoelectric device is left "ON" and the method 200 returns to step 230. If the temperature is not greater than the high set temperature, however, then the method 200 proceeds to step 260 (similar to the step 160 of method 100), and the at least one thermoelectric device is turned "OFF."

If the determination in step 240 results in a normal mode having been selected, then method 200 proceeds with step 285, wherein the temperature is checked to see if it is greater than the set temperature. If the temperature is greater than the set temperature, then the at least one thermoelectric device is left "ON" and the method 200 returns to step 230. If the temperature is not greater than the set temperature, however, then the method 200 proceeds to step 260 and the at least one thermoelectric device is turned "OFF."

Figure 11:
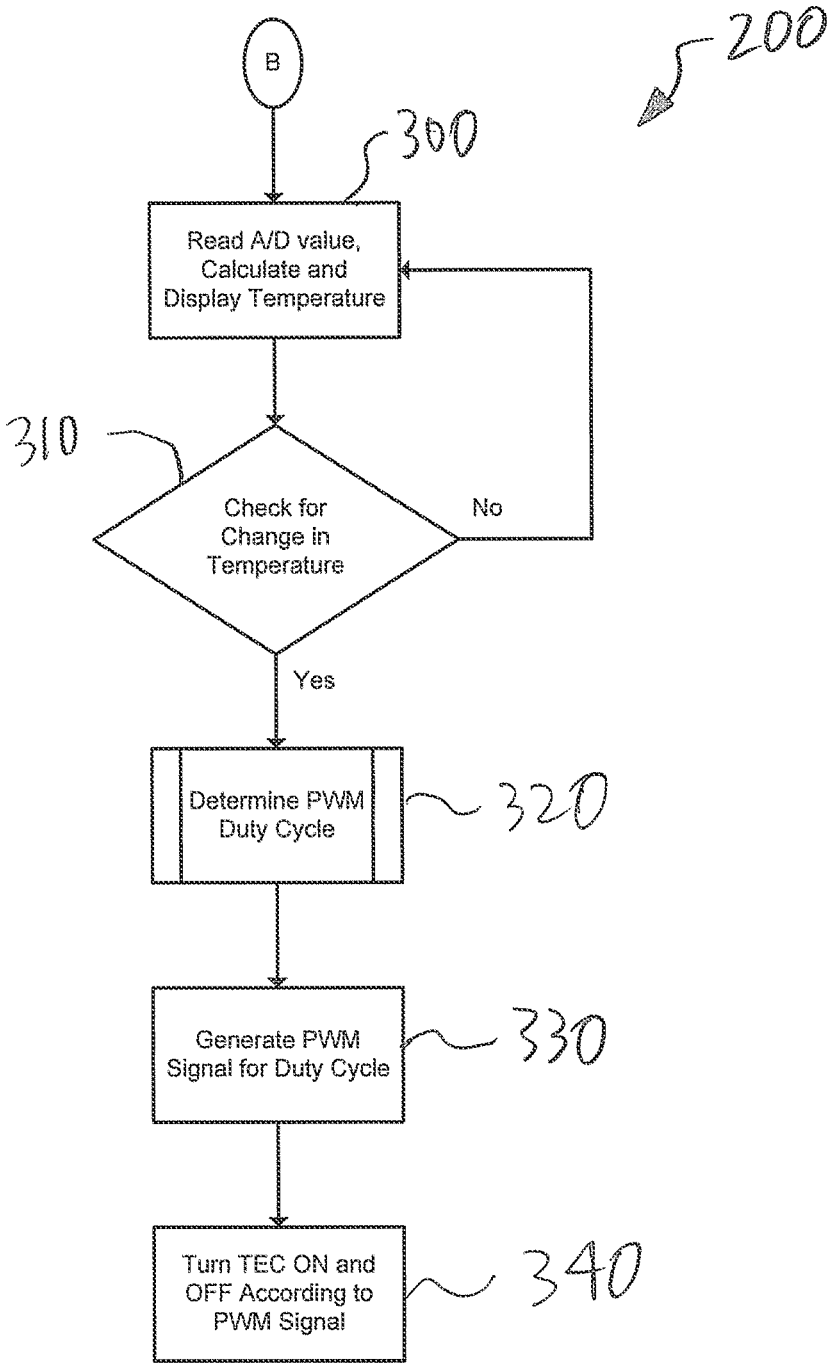
FIG. 11 illustrates a continuation of the example flowchart of FIG. 10.

After the at least one thermoelectric device is turned "OFF" in step 260, the method 200 continues to step 300, as shown in FIG. 11. In step 300, the microcontroller reads the A/D converter, calculates the temperature, and displays the temperature (if a display is present). Next, the calculated temperature is evaluated in step 310 to see if there has been any change in temperature. If there has not been a change in temperature, then the method returns to step 300. If there has been a change in temperature, however, then the method proceeds with step 320, wherein a determination of the PWM duty cycle is made. The determination of the PWM duty cycle is explained in more detail below and shown in FIG. 12. Once, the PWM duty cycle has been determined, the method 200 proceeds to step 330, wherein the microcontroller generates at least one PWM signal that corresponds to the duty cycle determined in step 320. After step 330, the method continues with step 340, wherein the at least one thermoelectric device is turned "ON" and "OFF" as indicated by the at least one PWM signal pattern.

Figure 12:
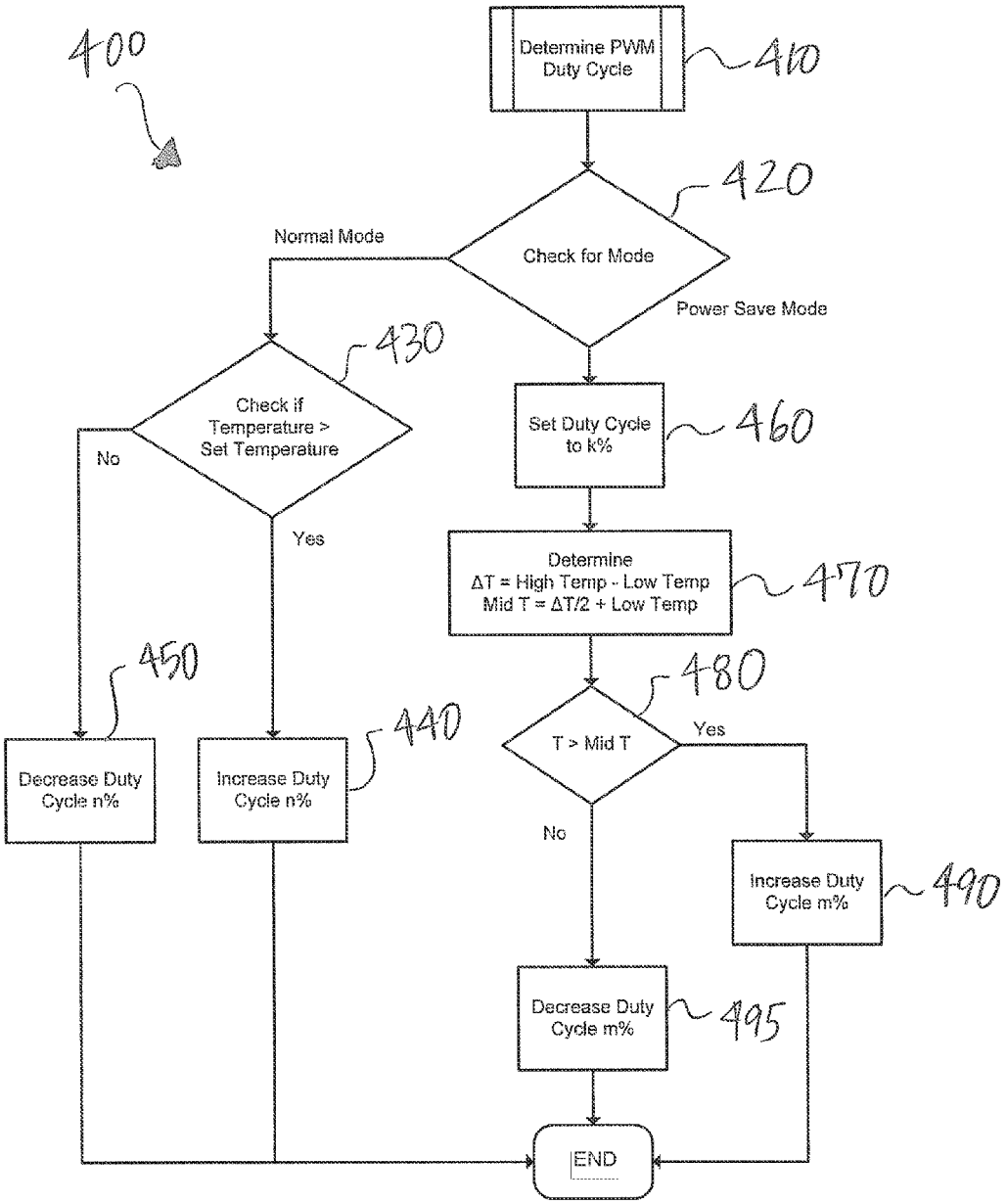
FIG. 12 illustrates an example flowchart including example functional steps for determining a pulse width modulation duty cycle, as shown in FIG. 11, for the control system of FIG. 1.

A method 400 for determining the PWM duty cycle (step 320) is shown in FIG. 12. The determination of the PWM duty cycle 410 begins with a check of what mode of operation has been selected in step 420. If a normal mode of operation has been selected, then method 400 proceeds to step 430, wherein a determination is made to see if the temperature is greater than the set temperature. If the temperature is greater than the set temperature, then the method 400 proceeds with step 440, wherein the duty cycle is increased to n %. On the other hand, if the temperature is not greater than the set temperature, then the duty cycle may be decreased to n %. The variable "n" for these percentage increases and decreases may be predetermined according to the accuracy of the cooling temperature requirements and the design, user, and/or manufacturing preferences for the particular application being utilized. After the increase in duty cycle to n % in step 440, or after the decrease in duty cycle to n % in step 450, the method 400 ends and the control process returns to step 330 in method 200. At that point, the new PWM duty cycle (n %) determined by method 400 is translated into at least one PWM signal that is generated by the microcontroller and then executed by the at least one thermoelectric device.

Returning to step 420 of method 400, as shown in FIG. 12, if a power save mode has been selected, the method proceeds with step 460, wherein the duty cycle is set to k %. Next, in step 470, the method 400 determines the high and low temperature range (ΔT), as well as the mid temperature based on that temperature range. The temperature range differential is based on Equation 1, shown below:

$$\Delta T = \text{High Set Temperature} - \text{Low Set Temperature}. \qquad \text{Equation (1)}$$

The mid temperature may be calculated using Equation 2, shown below:

$$\text{Mid Temperature} = \Delta T/2 + \text{Low Set Temperature}. \qquad \text{Equation (2)}$$

After the temperature differential and mid temperature are calculated in step 470, the method 400 continues with step 480, wherein a determination is made to see if the temperature is greater than the mid temperature. If the temperature is greater than the mid temperature, then the method 400 proceeds to step 490, wherein the duty cycle is increased to m %. If the temperature is not greater than the mid temperature, however, then the method 400 proceeds to step 495, wherein the duty cycle is decreased to m %. The variables "k" and "m" for the duty cycle percentages used in a power save mode may be based on user input or predetermined based on the characteristics and parameters associated with the thermoelectric device being used. Such characteristics and parameters include the power/voltage used by the thermoelectric device, the efficiency of the thermoelectric device, the cooling room temperature area, the atmospheric temperature, the thermal installation between the cooling room temperature and the atmosphere temperature, etc. As in a normal mode, once the increase or decrease in duty cycle to m % in a power save mode had been processed in steps 490 and step 495, respectively, the method 400 ends and the appropriate PWM signal pattern for the m % duty cycle is generated in step 330 and executed in step 340 of method 200.

An example method 500 for the key interrupt initialized in steps 110 and 210 of methods 100 and 200, respectively, is shown in FIG. 12. The key interrupt 510 begins with step 520, wherein a check is made to see if a normal mode has been selected. If a normal mode has been selected, then the method 500 proceeds to step 530, wherein operating temperature settings (e.g., set temperature) are obtained from user key input. In steps 530, the temperature settings may also be set as default values for the normal mode of operation by storing the user key input operating temperature settings in one of the memory devices 18, 20. After step 530, the method 500 ends and returns to the start of either method 100 or method 200.

In method 500, if a normal mode has not been selected, then a check is made to see if a power save mode has been selected, in step 540. If a power save mode has been selected, then the method 500 proceeds with step 550, wherein the high and low set temperature settings (or a duty cycle) are obtained from user key input. In step 550, the high and low set temperatures settings obtained may also be set as default values for the power save mode of operation by storing the user key input high and low operating temperature settings in one of the memory devices 18, 20. After step 550, method 500 ends and returns to the start of either method 100 or method 200.

Figure 13:
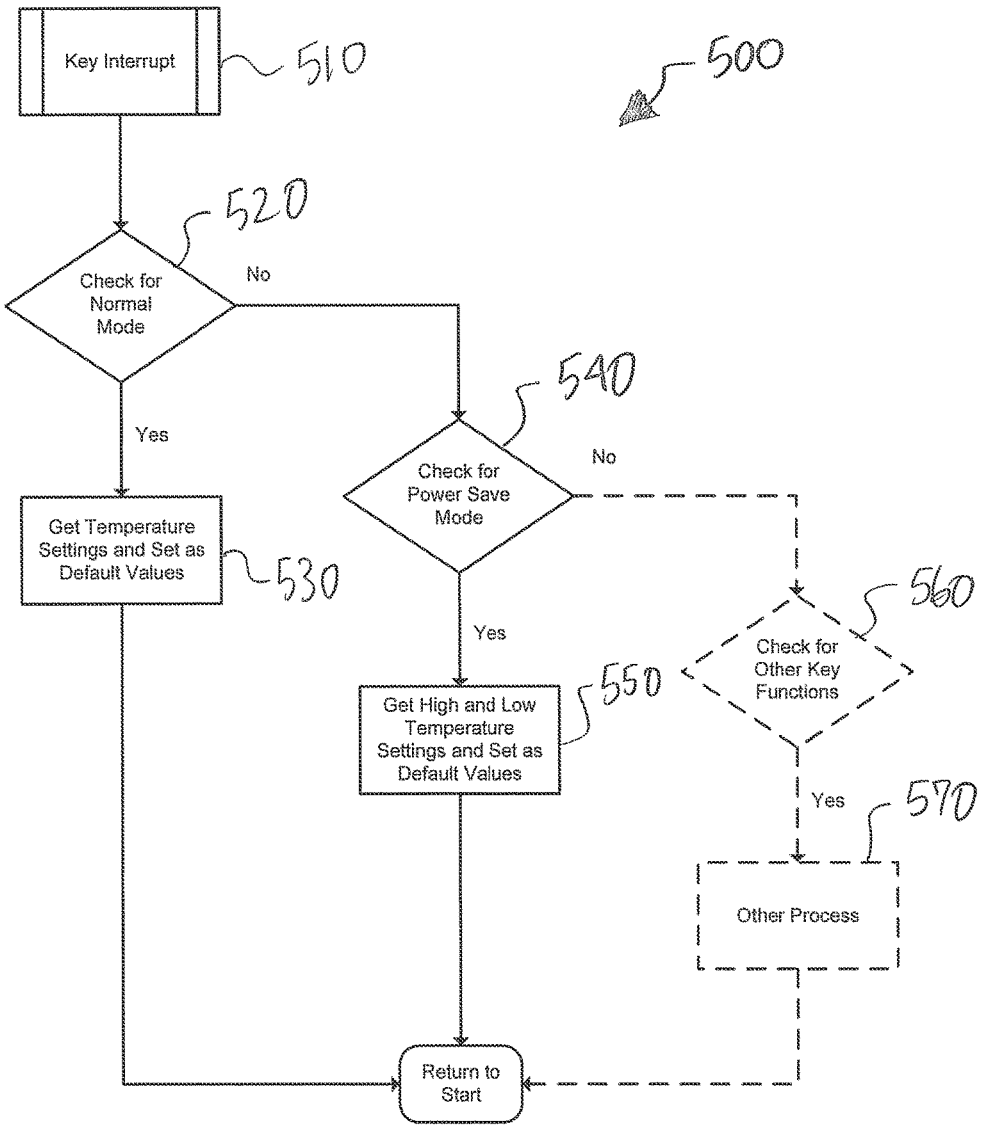
FIG. 13 illustrates an example flowchart including example functional steps for a key interrupt for the control system of FIG. 1.

If a power save mode has not been selected, as determined in step 540, then the method 500 may end, or alternatively, as shown in the dash lines in FIG. 13, the method 500 may proceed to step 560, wherein a check is made to see if any other key functions have been input by a user. If so, then those other key functions are processed in step 570. If not, then method 500 ends and returns to the start of either method 100 or method 200.

The optional key interface 42 may be interfaced with I/O pins of the microcontroller and may be configured to generate a key press interrupt to the microcontroller. The key interrupt method 500 may be initiated at any time after steps 110 and 210 by a user via an input device 42. This key interrupt method 500 allows a user to interrupt the control system and change its mode of operation from a normal mode to a power save mode or from a power save mode to a normal mode. As explained above, the key interrupt method 500 may also allow a user to initiate other key functions related to the control system, such as display the reference temperature, the set temperature, duty cycle % (e.g., k % and m %), and other parameters regarding the status of the control system. Such other key functions may also provide additional flexible applications like real time clock setting, setting the thermoelectric device operation in between the real time clock periods for extended power save mode, etc.

The temperature and duty cycle settings for the microcontroller 10 may be stored as one or more lookup tables, such as a first lookup table 80 and a second lookup table 90, shown in FIGS. 14 & 15, respectively, which in turn may be stored in one of the memory devices 18, 20. The first lookup table 80, as shown in FIG. 14, may be used to provide a correlation of the A/D converter values of the at least one digital temperature signal to temperature values that can be displayed to a user of the control system 5, as well as that can be used by the CPU 12 and the operating instructions stored in the one or more memory devices of the microcontroller 10 for calculation and control processes.

The second lookup table 90 may be used to correlate the temperatures stored in the first lookup table 80 with a corresponding duty cycle for the at least one PWM signal 26. As shown in FIG. 15, the higher the temperature read by the A/D converter, the higher the corresponding duty cycle for the at least one PWM signal.

Using the embodiments described herein, one or more thermoelectric devices, such as a TEC, may be controlled directly with a microcontroller in an efficient, inexpensive, flexible, upgradeable, and fully customizable manner. Thus, the control systems and methods described and shown herein overcome the above problems associated with the prior art. Indeed, the efficiency, inexpensiveness, flexibility, upgradeability, and customization achieved by the embodiments of the present application are not available when the analog circuitry of the prior art is used to control and generate the drive signal for the at least one thermoelectric device.

In general, it should be understood that the circuits described herein may be implemented in hardware using integrated circuit development technologies, or yet via some other methods, or the combination of hardware and software objects that could be ordered, parameterized, and connected in a software environment to implement different functions described herein. For example, several functions of the present application may be implemented using a general purpose or dedicated processor running a software application through volatile or non-volatile memory. Also, the hardware objects could communicate using electrical signals, with states of the signals representing different data.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into sub-ranges as discussed above. Finally, as will be understood by one skilled in the art, a range includes each individual member. Thus, for example, a temperature range between 13 and 19 degrees refers to 13 degrees, 19 degrees, and all the degrees between 13 and 19 degrees.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

It should be further understood that this and other arrangements described herein are for purposes of example only. As such, those skilled in the art will appreciate that other arrangements and other elements (e.g., machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

What is claimed is:

1. A control system for a thermoelectric device, the control system comprising:

a temperature sensor effective to sense a temperature; and a microcontroller operatively coupled to the temperature sensor, wherein the microcontroller comprises a central processing unit, at least one memory device, and a module effective to generate at least one pulse width modulation signal, wherein the at least one pulse width modulation signal, generated by the microcontroller, is effective to drive the thermoelectric device, and wherein the microcontroller is configured to:

determine whether a first mode of operation related to hysteresis, or a second mode of operation related to high and low set temperatures, is selected;

when the first mode is selected, set an upper hysteresis temperature limit and a lower hysteresis temperature limit and dynamically adapt a pulse width of the at least one pulse width modulation signal responsive to the sensed temperature such that the pulse width corresponds to a first duty cycle based on the upper hysteresis temperature limit and the lower hysteresis temperature limit; and thereafter, when the second mode is selected, set a high set temperature and a low set temperature and dynamically adapt the pulse width of the at least one pulse width modulation signal responsive to the sensed temperature such that the pulse width corresponds to a second duty cycle based on the high set temperature and the low set temperature, wherein to dynamically adapt the pulse width of the at least one pulse width modulation signal such that the pulse width corresponds to the second duty cycle, the microcontroller is effective to:

calculate a reference temperature, wherein the reference temperature is between the high set temperature and the low set temperature;

compare the sensed temperature to the reference temperature to determine a difference between the sensed temperature and the reference temperature;

determine a dynamic percentage change of the duty cycle, wherein the dynamic percentage change of the duty cycle varies based on parameters of the thermoelectric device, based on the difference between the sensed temperature and the reference temperature, and based on an atmospheric temperature;

increase the second duty cycle by the dynamic percentage when the sensed temperature exceeds the reference temperature; and decrease the second duty cycle by the dynamic percentage when the sensed temperature is less than or equal to the reference temperature.

2. The control system of claim 1, wherein the at least one pulse width modulation signal comprises at least a first state and a second state, the first state signaling that the thermoelectric device should be turned on, and the second state signaling that the thermoelectric device should be turned off.

3. The control system of claim 2, wherein the at least one pulse width modulation signal comprises at least two separate first states and at least two separate second states, and wherein the thermoelectric device is turned on at least twice and turned off at least twice.

4. The control system of claim 1, wherein the temperature sensor generates at least one analog temperature signal, wherein the microcontroller further comprises an analog-to-digital converter operatively coupled to the temperature sensor, and wherein the analog-to-digital converter converts the at least one analog temperature signal into at least one digital temperature signal.

5. The control system of claim 4, further comprising an analog signal conditioner coupled between the temperature sensor and the analog-to-digital converter.

6. The control system of claim 1, further comprising a display and at least one input device coupled to the microcontroller.

7. The control system of claim 1, further comprising a power amplifier coupled between the module and the thermoelectric device, wherein the power amplifier is effective to amplify the at least one pulse width modulation signal.

8. The control system of claim 1, further comprising an external clock effective to provide an independent time base for generation of the at least one pulse width modulation signal.

9. A method of controlling a thermoelectric device, the method comprising:

providing a microcontroller operatively coupled to a temperature sensor, the microcontroller comprising a central processing unit, at least one memory device, and a module operatively coupled to at least one thermoelectric device;

sensing a temperature with the temperature sensor;

generating at least one pulse width modulation signal with the module of the microcontroller;

transmitting the at least one pulse width modulation signal from the microcontroller to the thermoelectric device;

driving the thermoelectric device in accordance with the at least one pulse width modulation signal effective to generate a pulse with a pulse width;

determining whether a first mode of operation related to hysteresis, or a second mode of operation related to high and low set temperatures, is selected;

when the first mode is selected, setting an upper hysteresis temperature limit and a lower hysteresis temperature limit and dynamically adapting the pulse width of the at least one pulse width modulation signal responsive to the sensed temperature such that the pulse width corresponds to a first duty cycle based on the upper hysteresis temperature limit and the lower hysteresis temperature limit; and thereafter, when the second mode is selected, setting a high set temperature and a low set temperature and dynamically adapting the pulse width of the at least one pulse width modulation signal responsive to the sensed temperature such that the pulse width corresponds to a second duty cycle based on the high set temperature and the low set temperature, wherein dynamically adapting the pulse width of the at least one pulse width modulation signal such that the pulse width corresponds to the second duty cycle, comprises:

calculating a reference temperature, wherein the reference temperature is between the high set temperature and the low set temperature;

comparing the sensed temperature to the reference temperature to determine a difference between the sensed temperature and the reference temperature;

determining a dynamic percentage change of the duty cycle, wherein the dynamic percentage change of the duty cycle varies based on parameters of the thermoelectric device, based on the difference between the sensed temperature and the reference temperature, and based on an atmospheric temperature;

increasing the second duty cycle by the dynamic percentage based on a determination that the sensed temperature exceeds the reference temperature; and decreasing the second duty cycle by the dynamic percentage based on a determination that the sensed temperature is less than the reference temperature.

10. The method of claim 9, wherein the at least one pulse width modulation signal comprises a first state and a second state, the first state signaling that the thermoelectric device should be turned on, and the second state signaling that the thermoelectric device should be turned off.

11. The method of claim 10, wherein the at least one pulse width modulation signal comprises at least two separate first states and at least two separate second states, and wherein the thermoelectric device is turned on at least twice and turned off at least twice.

12. The method of claim 9, further comprising converting at least one analog temperature signal into at least one digital temperature signal, and using the at least one digital temperature signal to generate the at least one pulse width modulation signal.

13. The method of claim 9, further comprising generating the at least one pulse width modulation signal after the sensed temperature has reached a set temperature.

14. The method of claim 9, further comprising providing a key interrupt that allows a user to select one of at least a normal mode of operation and a power save mode of operation.

15. A microcontroller, comprising:

at least one memory device, wherein the at least one memory device includes a set of operating instructions for the microcontroller;

a central processing unit effective to execute the set of operating instructions; and a module effective to generate at least one pulse width modulation signal that can drive a thermoelectric device, wherein the at least one pulse width modulation signal includes at least a first state and a second state, wherein the first state turns the thermoelectric device on, the second state turns the thermoelectric device off, and the at least one pulse width modulation signal comprises at least two separate first states and at least two separate second states, and wherein the microcontroller is configured to:

determine whether a first mode of operation related to hysteresis, or a second mode of operation related to high and low set temperatures, is selected;

when the first mode is selected, set an upper hysteresis temperature limit and a lower hysteresis temperature limit and dynamically adapt a pulse width of the at least one pulse width modulation signal of the first state or the second state based on a sensed temperature such that the pulse width corresponds to a first duty cycle based on the upper hysteresis temperature limit and the lower hysteresis temperature limit; and thereafter, when the second mode is selected, set a high set temperature and a low set temperature and dynamically adapt the pulse width of the at least one pulse width modulation signal responsive to the sensed temperature such that the pulse width corresponds to a second duty cycle based on the high set temperature and the low set temperature, wherein to dynamically adapt the pulse width of the at least one pulse width modulation signal such that the pulse width corresponds to the second duty cycle, the microcontroller is further effective to:

calculate a reference temperature, wherein the reference temperature is between the high set temperature and the low set temperature;

compare the sensed temperature to the reference temperature to determine a difference between the sensed temperature and the reference temperature;

determine a dynamic percentage change of the duty cycle, wherein the dynamic percentage change of the duty cycle varies based on parameters of the thermoelectric device, based on the difference between the sensed temperature and the reference temperature, and based on an atmospheric temperature;

increase the second duty cycle by the dynamic percentage based on a determination that the sensed temperature exceeds the reference temperature; and decrease the second duty cycle by the dynamic percentage based on a determination that the sensed temperature is less than the reference temperature.

16. The microcontroller of claim 15, further comprising an analog-to-digital converter to convert at least one analog temperature signal to at least one digital temperature signal.

17. The microcontroller of claim 15, further comprising:

a display port and an input device port, wherein the display port is effective to couple a display to the microcontroller, wherein the input device port is effective to couple an input device to the microcontroller, and wherein the display port and the input device port are effective to allow a user to interact with and control the microcontroller via the display and the input device.

18. The microcontroller of claim 15, wherein the upper hysteresis temperature limit is different from the high set temperature, and the lower hysteresis temperature limit is different from the low set temperature.

19. The microcontroller of claim 15, wherein the upper hysteresis temperature limit is different from at least one of the high set temperature and the low set temperature.

20. The microcontroller of claim 15, wherein the lower hysteresis temperature limit is different from at least one of the high set temperature and the low set temperature.

* * * * *